United States Patent [19]

Culver

[11] Patent Number: 4,472,661

[45] Date of Patent: Sep. 18, 1984

[54] HIGH VOLTAGE, LOW POWER TRANSFORMER FOR EFFICIENTLY FIRING A GAS DISCHARGE LUMINOUS DISPLAY

[76] Inventor: Clifford T. Culver, 39046 180th St. East, Palmdale, Calif. 93550

[21] Appl. No.: 431,471

[22] Filed: Sep. 30, 1982

[51] Int. Cl.[3] ..... H05B 41/14

[52] U.S. Cl. ..... 315/276; 315/206; 315/219; 315/224; 315/279; 315/307; 315/DIG. 7

[58] Field of Search ..... 315/206, 219, 224, 276, 315/279, 307, DIG. 7; 331/117 R

[56] References Cited

U.S. PATENT DOCUMENTS 3,609,452 9/1971 Skirvin ..... 315/276 X

FOREIGN PATENT DOCUMENTS 2705170 10/1977 Fed. Rep. of Germany ..... 315/219

*Primary Examiner*—Eugene R. Laroche

*Attorney, Agent, or Firm*—Klein, Szekeres & Fischer

[57] ABSTRACT

A power system comprising a high voltage, low power transformer that utilizes self-resonance parameters and pulse control techniques for efficiently firing a gas discharge lamp of the type commonly used to form a luminous advertising display. The transformer is fabricated from a material, such that the transformer will have a characteristic self-resonating frequency. The transformer is driven by Direct Current pulses from a source of supply thereof. The widths of the current pulses are controlled so as not to exceed one fourth the wavelength of the self-resonating frequency of the transformer. Performance is optimized when the repetition rate of the current pulses is directly controlled according to the self-resonating frequency of the transformer. By virtue of the present invention, an efficient transformer of relatively low weight, size, and cost is provided by which to fire the lamp of the display and thereby produce an apparent optical intensity that is approximately equal to that available from a conventional gas discharge power transformer. However, the energy consumed by the present transformer is substantially less than that expended by presently available transformers.

16 Claims, 7 Drawing Figures

HIGH VOLTAGE, LOW POWER TRANSFORMER FOR EFFICIENTLY FIRING A GAS DISCHARGE LUMINOUS DISPLAY

BACKGROUND OF THE INVENTION

1. Field of the Invention

This invention relates to a fabrication method for and the corresponding apparatus of a high voltage, low power transformer by which to efficiently fire a gas discharge lamp, such as that commonly utilized to form a luminous advertising display.

2. Prior Art

As will be known to those skilled in the art, gap discharge devices, such as, for example, a neon gas discharge lamp, or the like, typically include an associated power system comprising a transformer by which to fire and ignite the lamp. Frequently, a plurality of such gas discharge lamps are arranged to form a luminous display by which a vendor may advertise to passersby his goods or services. However, the conventional gas discharge power transformer is plagued by several shortcomings which limit both the application and flexibility of an advertising display to which the transformer is interconnected. More particularly, the prior art power transformer is typically characterized by a relatively large and cumbersome iron laminated core. Thus, the weight, size, and, accordingly, the cost of the prior art transformer are undesirably increased. Moreover, for low frequency operation, the large transformer core requires many wire turns for establishing the primary and secondary windings thereof. Of course, the time, cost, and raw materials required to manufacture a transformer having a large core and a multiplicity of wire turns are undesirably maximized.

Another difficulty which has been frequently encountered as a result of utilizing a conventional power transformer for driving a gas discharge lamp is poor power efficiency. That is, the conventional transformer is known to draw the same current and consume the same amount of power, whether or not a load is being driven thereby. Such current and power characteristics result from the nature of known constant current-type transformers which behave more like a shunt regulator than a series regulator.

In any event, the high cost, large size and weight, and poor energy efficiency disadvantageously limit the application and practicality of the conventional gas discharge power transformer in any gap discharge system where the conservation of cost, space, and energy are important considerations.

SUMMARY OF THE INVENTION

Accordingly, it is a primary object of the present invention to provide a power system and a high voltage, low power transformer thereof having particular parameters by which to fire a gas discharge, luminous advertising display, or the like.

It is another object of this invention that the present power system include a pulse source for controlling the operation of the transformer, the repetition rate of the pulse source being set at or slightly below the self-resonating frequency of the transformer in order that the transformer may be characterized by a variable duty cycle of relatively short duration.

It is still another object of this invention to fabricate the present power system transformer according to a method which will enable an energy efficient use thereof and a reduction in the heat dissipated thereby.

It is yet another object of this invention that the present method of fabrication provide a transformer which is adapted to drive a luminous display to a relatively high apparent optical intensity while eliminating a flickering visual effect, which has heretofore been common in many advertising displays.

It is a further object of this invention that the present transformer have a relatively small size and weight, whereby to minimize the consumption of raw materials during the manufacture thereof.

It is an additional object of this invention to provide a transformer having a relatively low cost of manufacture.

Further objects and advantages of the present invention will become apparent as the following description proceeds and the features of novelty which characterize this invention are pointed out with particularity in the claims appended hereto.

DESCRIPTION OF THE PREFERRED EMBODIMENT

Figure 1:
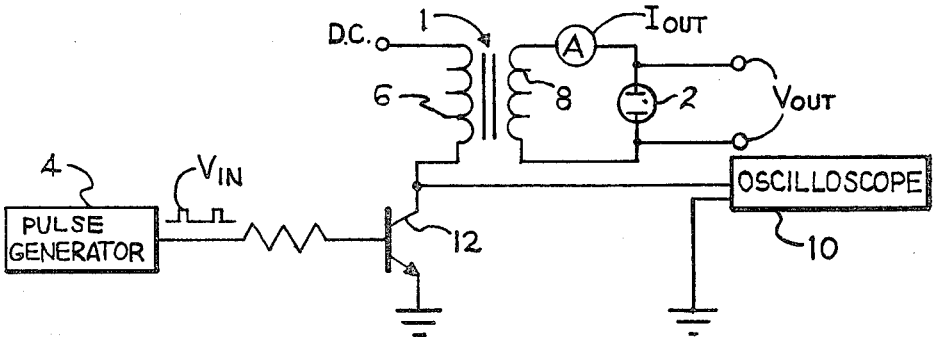
FIG. 1 is a schematic of a circuit by which to determine the self-resonance parameters for the high voltage, low power transformer which forms the present invention.

A power system and, more particularly, a high voltage, low power transformer having particular parameters so as to be adapted to efficiently drive a gap discharge device, such as a gas discharge lamp, is disclosed in detail while referring to the drawings. The present power system has particular application for firing a luminous advertising display comprising a gas discharge lamp that is typically filled with either neon, argon, mercury vapor, helium, or the like. For the purpose of illustration and referring initially to FIG. 1 of the drawings, a power system is shown having an energy efficient transformer 1. Transformer 1 is fabricated from a particular material, such that transformer 1 will have a characteristic self-resonating frequency. In general terms, the self-resonating frequency of transformer 1 is the frequency at which the transformer inductors resonate with no external capacitance. The self-resonating frequency is determined by the inner winding capacitance between the inductor turns of transformer 1. By way of a preferred embodiment of the invention, the transformer is fabricated from a commercially available ferrite material. One such suitable ferrite material is known as type 43515-EC and is available from Magnetics, Incorporated of Butler, Pa. It is to be understood that the transformer material is not limited to a ferrite and other suitable materials (including an air core) may be utilized herein. However, transformers fabricated from iron and steel laminations, and the like, as well as those transformers having a tape wound core are not suitable to form the transformer 1.

The transformer 1 is driven by a train of current pulses, which pulses have a predetermined width. More particularly, the pulse width is determined according to the self-resonating characteristics of the transformer. That is, and in accordance with the present invention, transformer 1 is driven by current pulses having a width which is selectively controlled so as to be less than or equal to one fourth the wavelength of the self-resonating frequency of the transformer. Varying the width of the current pulses acts to regulate the average transformer power and the intensity at which the lamp of an advertising display is illuminated.

The self resonating frequency of the transformer 1 may be determined in the power system of FIG. 1 by means of a pulse generator 4 and an electronic switching device 12. Pulse generator 4 is adjusted to provide output pulses having approximately a one microsecond pulse width and a 1.0% duty cycle. The primary winding 6 of transformer 1 is implemented by 20 wire turns, while the secondary winding 8 thereof is implemented by a suitable number of turns, whereby the resulting turns ratio provides an output voltage level sufficient for firing a load (i.e. gas discharge lamp 2). When the load 2 is fired, the ringing frequency is measured by means of an oscilloscope 10. As is illustrated in FIG. 1, oscilloscope 10 is connected to a conduction path electrode (i.e. the collector) of a NPN transistor switching device 12. Pulse generator 4 is connected to the base electrode of transistor 12 via a current limiting resistor, so as to prevent a current overload at the transistor base. The primary winding 6 of transformer 1 is interconnected in electrical series between a Direct Current source of supply and the collector electrode of transistor 12. The secondary winding 8 of transformer 1 is connected in electrical series with gas discharge lamp 2. The ringing frequency of transformer 1 as measured at oscilloscope 10, is indicative of the self-resonating frequency of the transformer.

It has been found that the operating efficiency of transformer 1 is maximized when the primary winding 6 of transformer 1 is supplied with current pulses from the D.C. source of supply, the respective widths of which pulses being less than or equal to one fourth the wavelength of the self-resonating frequency of the transformer, as previously disclosed. By way of particular example, it has been further found that a transformer having a core that is fabricated from a ferrite material (such as that identified above) and a primary winding 6 having 20 wire turns and developing a voltage thereacross of approximately 8 volts per turn provides efficient transformer operation. By way of example, it has been determined that the present transformer 1 operating at 24 watts of input power is adapted to illuminate lamp 2 at an optical intensity that is substantially equivalent to the intensity which is available by means of a conventional transformer which utilizes 175 watts of input power. What is more, and as will be explained in greater detail hereinafter, the presently disclosed transformer 1 is also adapted to minimize power loss, dissipate less heat, and, accordingly, have a correspondingly lower operating temperature than prior art power transformers. By way of additional advantage, the present transformer 1 has a relatively small size and low mass (e.g. approximately 10% of the size and mass of a transformer which has heretofor been used to power an advertising display). Therefore, the cost of transformer manufacture may be reduced, so as to increase the number of applications for which the instant transformer is suitable.

Figure 2A:
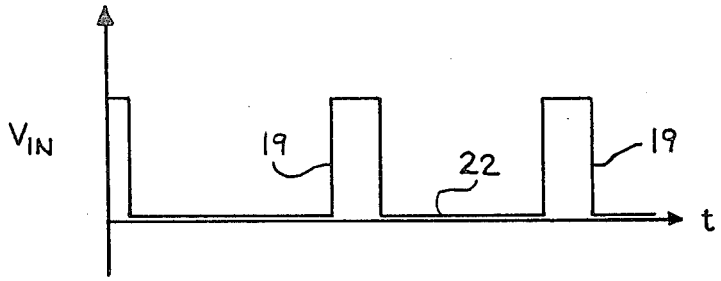
FIG. 2*a* represents the voltage waveform of input pulses used to control the operation of the present transformer.

Referring concurrently to FIGS. 1 and 2*a* of the drawings, there is represented in FIG. 2*a* the input voltage waveform (designated $V_{in}$) of a pulse train being supplied from the output of pulse generator 4 to the base electrode of transistor switch 12 to control the operation of transformer 1. As will be disclosed in greater detail when referring to FIGS. 3–5, the reptetion rate of the control pulses being supplied by pulse generator 4 is selectively regulated so as to be made substantially equivalent to the self-resonating frequency of transformer 1.

During the occurrence of each control pulse 19 from pulse generator 4, transistor switch 12 is rendered conductive. Accordingly, D.C. current pulses are conducted through the conduction path of transistor switch 12 via the primary winding 6 of transformer 1. Thus, during the presence of a control pulse 19, gas discharge lamp 2 is fired and energy is stored by transformer 1. During the absence of a control pulse (designated 22), transistor switch 12 is rendered non-conducting, so as to block the current path through primary winding 6 and cause energy stored by transformer 1 to be released. Accordingly, gas discharge lamp 2 will produce a relatively high apparent optical intensity, while minimizing the appearance of flicker. Therefore, the advertising display will appear to the observer to be continuously illuminated.

Figure 2B:
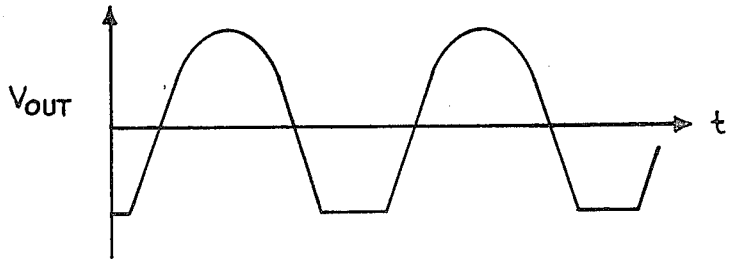
FIG. 2*b* represents the output voltage waveform of the present transformer.

FIG. 2*b* of the drawings represents the output voltage waveform (designated $V_{out}$) of the transformer 1 that is controlled by the pulses of FIG. 2*a*. More particularly, the output voltage waveform of FIG. 2*b* is caused by pulse excitation of self-resonance of the transformer 1. By virtue of the present invention, the gas discharge lamp of an advertising display is fired or ignited during pulse excitation, which ignition continues throughout the resonance cycle by way of the stored energy which is released during the absence of a control pulse 19 of FIG. 2*a*. In the power system of FIG. 1, illumination of gas discharge lamp 2 is regulated by means of pulse width control, rather than by power consuming shunt regulation as is common to power systems in which a conventional gas discharge power transformer is employed. Hence, utilization of a power system with the transformer 1 and the pulse control techniques as have been disclosed above can result in a conservation of energy and a more efficient operation (i.e. a brighter apparent intensity) for the gas discharge lamp 2 of a luminous advertising display.

Figure 2C:
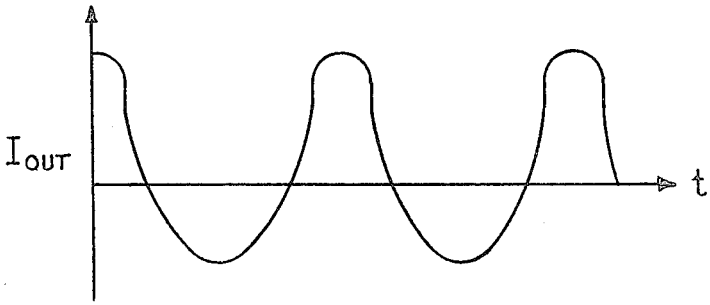
FIG. 2*c* represents the output current waveform of the present transformer.

FIG. 2*c* of the drawings represents the output current waveform (designated $I_{out}$) of the transformer 1 of FIG. 1. The output current of transformer 1 may be measured by connecting a suitable ammeter, designated A, in series with the secondary winding 8 thereof. The current waveform of FIG. 2*c* indicates that current is drawn by gas discharge lamp 2 throughout the entire period of the pulse cycle of FIG. 2*a*. That is, current is drawn by lamp 2 during both the presence 19 and absence 22 of a control pulse from pulse generator 4. The continuous current draw is caused by the repetitive storage and release of energy by the inductors which form the transformer 1.

Figure 3:
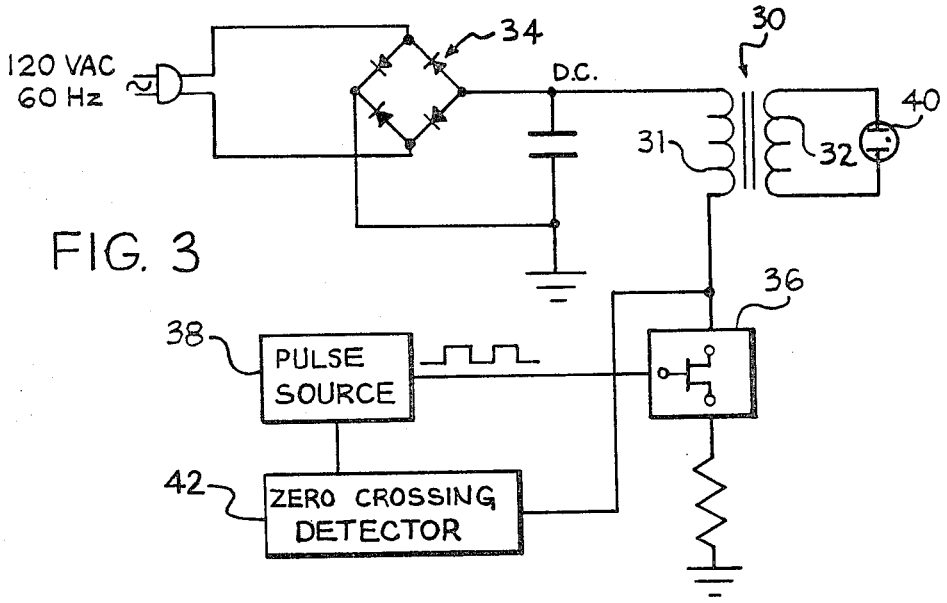
FIG. 3 is a schematic circuit of a power system by which to fire a gas discharge luminous display by means of the present transformer having a single core configuration.
Figure 4:
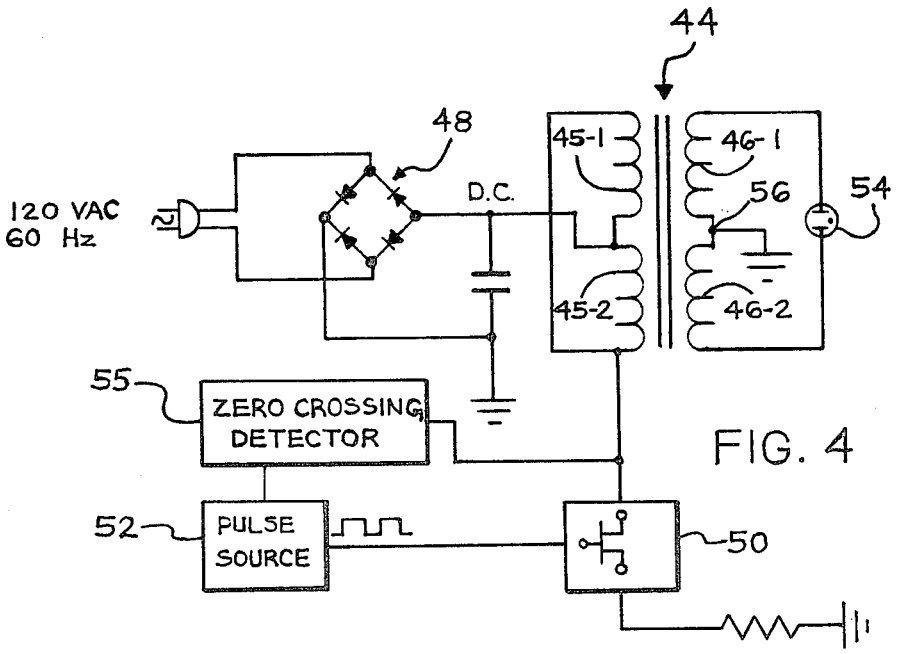
FIG. 4 is a schematic circuit of a power system by which to fire a gas discharge luminous display by means of the present transformer having a dual core configuration.
Figure 5:
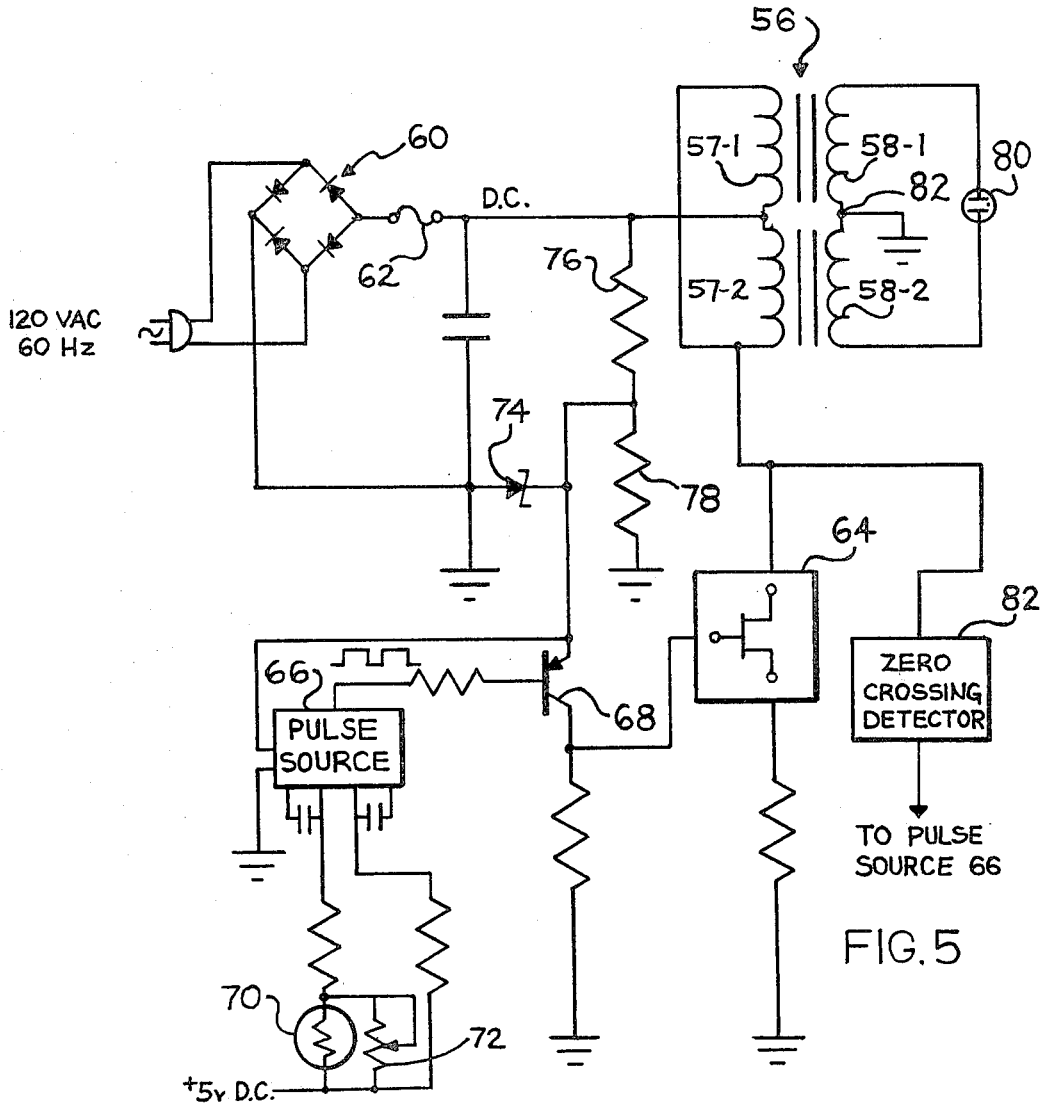
FIG. 5 is a schematic circuit of a power system by which to fire a gas discharge luminous display by means of the present transformer having a different dual core configuration from that illustrated in FIG. 4.

Schematics of other power systems that include an energy efficient, high voltage, low power transformer by which to drive a gas discharge advertising display are illustrated in FIGS. 3-5 of the drawings. Referring initially to FIG. 3, the present pulse transformer 30 is shown implemented with a single core configuration. The presently disclosed power system is powered from a readily available 120 volt A.C., 60 Hertz source of supply. The supply voltage is rectified by means of a conventional full wave diode bridge 34. Accordingly, one end of the primary winding 31 of transformer 30 is connected to receive from diode bridge 34 an input D.C. current. The primary winding 31 preferably includes approximately 20 wire turns. The second end of primary winding 31 is connected to an electronic switch 36. Switch 36 is preferably either of a bipolar transistor or a power field effect transistor driver that is adapted to control the current flow through primary winding 31. By way of particular example, switch 36 is a field effect transistor having a high breakdown potential, such as transistor No. MTP2N85 manufactured by Motorola Corporation. Switch 36 is controlled by a pulse source 38, so that the width and repetition rate of the pulses being transmitted through primary winding 31 can be adjusted, as required. By way of particular example, pulse source 38 is a dual one shot multi-vibrator, such as that formed from a conventional CD4098 semiconductor chip. The secondary winding 32 of pulse transformer 30 is connected across the terminals of the system load or, more particularly, a gas (e.g. neon) discharge lamp 40. A zero crossing detector 42 is connected between pulse source (i.e. multi-vibrator) 38 and the conduction path of transistor switch 36, so as to be responsive to the output voltage of transformer 30. When the transistor output voltage changes from a relatively positive to a relatively negative level, detector 42 is adapted to reset the multi-vibrator stage of pulse source 38 that controls the repetition rate of the control pulses supplied to switch 36. At the same time, the multi-vibrator stage of pulse source 38 which controls the pulse width of the control pulses is fired, so that transformer 30 is energized by D.C. current pulses having a width of not greater than one-fourth the wavelength of the self-resonating frequency of the transformer 30. To optimize transformer performance, the repetition rate of pulse source 38 may be set by zero crossing detector 42 at or slightly below the self-resonating frequency of transformer 30, whereby transformer 30 may be characterized by a variable duty cycle of relatively short duration (no greater than 25%). A single core transformer configuration, such as that described when referring to FIG. 3, is preferable for powering relatively small luminous advertising displays when the output voltage developed across the secondary winding 32 of transformer 30 will generally not exceed 3,500 volts.

Referring now to the power system of FIG. 4 of the drawings, the present pulse transformer 34 is shown implemented with a first dual core configuration having respective pairs of primary and secondary windings. The present power system is also powered from a 120 volt A.C., 60 Hertz source of supply. The supply voltage is rectified by means of a full wave diode bridge 48. Accordingly, one end of each of the pair of primary windings 45-1 and 45-2 is connected to receive from diode bridge 48 an input D.C. current. Each of the primary windings 45-1 and 45-2 preferably includes approximately 20 wire turns. The second ends of each of the primary windings 45-1 and 45-2 are connected to an electronic switch 50, so that primary windings 45-1 and 45-2 are connected in electrical parallel relative to one another. Switch 50 is preferably either of a bipolar transistor or a power field effect transistor driver. In the present embodiment, switch 50 is a field effect transistor, such as transistor No. MTP2N85 manufactured by Motorola Corporation. Switch 50 is interconnected with a pulse source 52, so that the width and repetition rate of pulses being transmitted through the primary windings 45-1 and 45-2 can be selected, as required. As in the power system of FIG. 3, pulse source 52 is, for example, a dual one-shot multi-vibrator, such as that formed from a CD4098 semiconductor chip. The pair of secondary windings 46-1 and 46-2 of pulse transformer 44 are connected in electrical series relative to one another, which series connection is connected across the terminals of the load or, more particularly, gas (e.g. neon) discharge lamp 54. The center tap 56 of secondary windings 46-1 and 46-2 is connected to a source of reference potential, such as ground, so that the output voltage of transformer 54 is split between the secondary windings thereof. A zero crossing detector 54 is connected between pulse source (i.e. multi-vibrator) 52 and the conduction path of transistor switch 50, so as to be responsive to the output voltage of transformer 44. As previously disclosed when referring to FIG. 3, when the transformer output voltage changes from a positive to a negative level, zero crossing detector 54 acts to control the repetition rate and pulse width of the control pulses supplied to transistor switch 50 from pulse source 52, so that transformer 44 will be energized by D.C. current pulses having a width of not greater than one-fourth the wavelength of the self-resonating frequency of transformer 44. A dual core transformer configuration, such as that described when referring to FIG. 4, is preferable for powering relatively large luminous advertising displays, when the output voltage developed across the secondary windings 46-1 and 46-2 of transformer 44 will generally exceed 3,500 volts.

Referring now to the power system of FIG. 5 of the drawings, the present transformer 56 is shown implemented with another dual core configuration having respective pairs of primary and secondary windings. The power system of the present embodiment is powered from a 120 volt A.C., 60 Hertz source of supply. The supply voltage is rectified by means of a full wave diode bridge 60. Accordingly, one end of each of the pairs of primary windings 57-1 and 57-2 is connected, via a suitable fuse member 62, to receive from diode bridge 60 and input D.C. current. Each of the primary windings 57-1 and 57-2 preferably includes approximately 20 wire turns. The second ends of each of the primary windings 57-1 and 57-2 are connected to an electronic switch 64, so that the primary windings 57-1 and 57-2 are connected in electrical parallel relative to one another. Switch 64 is preferably either of a bipolar transistor or a power field effect transistor driver. In the present embodiment, switch 64 is field effect transistor, such as transistor No. MTP2N85, manufactured by Motorola Corporation. Switch 64 is connected to a conduction path electrode of a transistor device 68. The control electrode of transistor device 68 is connected to receive input pulses from a pulse source 66. By way of example, transistor device 68 is a PNP transistor, such as transistor No. 2N3906. Transistor device 68 serves as a power source for driving switch 64. By virtue of switch 64 and pulse source 66, the width of pulses being transmitted through primary windings 57-1 and 57-2 can be selectively controlled.

As has been previously disclosed, pulse source 66 is, for example, a dual one-shot multi-vibrator, such as that formed from a CD4098 semiconductor chip. More particularly, pulse source 66 may be a non-symmetrical multi-vibrator, wherein one side of the multi-vibrator controls the pulse width and the other side of the multi-vibrator controls the duty cycle. The side of said multi-vibrator which controls the pulse width may be interfaced with a commercially available thermistor 70. Thermistor 70 is adapted to reduce both the width of the output pulses and the amount of power consumed as the temperature of operation increases. The side of the multi-vibrator which controls the pulse width also includes a potentiometer 72 connected across thermistor 70. Potentiometer 72 is adapted to control the light intensity of the advertising display to which the power system of FIG. 6 is interconnected. A Zener diode 74 is connected between one end of diode bridge 60 and the emitter electrode of transistor device 68, so as to establish a D.C. voltage for pulse souce 66 and zero crossing detector 82. A pair of resistors 76 and 76 are connected in electrical series with one another between another end of diode bridge 60 and the emitter electrode of transistor device 68. Resistors 76 and 78 form a voltage divider to limit the voltage to pulse source 66 and zero crossing detector 82 in the event that Zener diode 74 should fail during operation.

The pair of secondary windings 58-1 and 58-2 of transformer 56 are connected in electrical series relative to one another, which series connection is connected across the terminals of the load or, more particularly, gas (e.g. neon) discharge lamp 80. The center tap 82 of secondary windings 58-1 and 58-2 is connected to a source of reference potential, such as ground, so that the output voltage of transformer 56 is divided between the secondary windings thereof. A zero crossing detector 82 is connected between pulse source (i.e. multi-vibrator) 66 and the conduction path of transistor switch 64, so as to be responsive to the output voltage of transformer 56. As previously disclosed when referring to FIG. 3, when the transformer output voltage changes from a positive to a negative level, zero crossing detector 82 acts to control the repetition rate and pulse width of the control pulses that are supplied by pulse source 66, so that transformer 56 will be energized by D.C. current pulses having a width of not greater than one-fourth the wavelength of the self-resonating frequency of transformer 56. A dual core configuration, such as that described when referring to FIG. 5, is preferable for powering large luminous advertising displays, when the output voltage developed across secondary windings 58-1 and 58-2 will substantially exceed 3,500 volts.

It is to be understood that the power systems for a gas discharge luminous display, as are illustrated in FIGS. 3-5, in which single and dual transformer core configurations are disclosed, are for exemplary purposes only. The present transformer may be included in other power systems and, therefore, no limitation of this invention is intended by the showing of the present transformer within any of the power systems of FIGS. 3, 4 or 5.

In the embodiments shown and described, the present transformer is a high voltage, low power transformer that is adapted to consume less energy when connected to a load (i.e. a gas discharge lamp) than that expended by transformers of the prior art. It has been found that transformer efficiency is maximized when each primary winding is characterized by 20 turns and 8 volts per turn. The characteristics of the secondary windings are dependent upon the requirements for driving the associated load. Inasmuch as the relative size, weight, and manufacturing cost of the presently disclosed transformer are minimized, the applications for which this transformer can be employed are increased, because size and weight limitations that have been encountered by prior art transformers are substantially overcome by the instant transformer.

The above-identified advantages of the presently disclosed transformer are achieved when the transformer is energized by current pulses which are sized according to certain transformer parameters (e.g. the self-resonating frequency of the transformer material). In accordance with the present invention and as has been disclosed in detail above, transformer efficiency is maximized when control pulses from a suitable source thereof are selectively regulated, so that the transformer is driven by current pulses having a width of less than or equal to one-fourth the wavelength of the self-resonating frequency of the transformer material.

It should be recognized that currently available transformers for powering a luminous display are constant current devices. Consequently, and as will be known by those skilled in the art, more power is consumed during current regulation than that consumed to power a gas discharge lamp of the display. However, for a power system in which the presently disclosed transformer is utilized, output power is regulated by means of controlling the width of the current pulses being supplied to the transformer and by inductive reactance, whereby to minimize power loss. Thus, the power systems which have been disclosed herein can be characterized as current limiting rather than current regulating. More particularly, it has been found that by driving the transformer hereof with high frequency current pulses, ionization of the gas in the lamp of an advertising display can be caused prior to reaching the lamp's striking potential. As an advantageous result, the gas discharge lamp may be illuminated before it is caused to fire hard.

It will be apparent that while a preferred embodiment of the present invention has been shown and described, various modifications and changes may be made without departing from the true spirit and scope of the invention. For example, while the present transformer has been described as having particular utility for firing a gas discharge advertising display, other applications are also contemplated therefor. By way of example, the presently disclosed transformer may be utilized within a video system, an ignition system, or other high voltage system.

Having thus set forth a preferred embodiment of the present invention, what is claimed is:

1. An electrical system for providing power to a load, said system including a source of current pulses and an energy efficient transformer interconnected between said source of current pulses and said load for receiving current pulses from said source and for driving said load, said transformer having primary and secondary windings and a core, said transformer being fabricated from a material which causes said transformer to have a self-resonating frequency, the widths of the current pulses that are supplied to said transformer being less than or equal to one-fourth the wavelength of the self-resonating frequency of the transformer.

2. The electrical system recited in claim 1, wherein said transformer is fabricated from a ferrite material.

3. The electrical system recited in claim 2, wherein the primary winding of said transformer comprises 20 wire turns capable of supporting a voltage thereacross of approximately 8 volts per turn.

4. The electrical system recited in claim 1, wherein said source of current pulses comprises a Direct Current source connected in electrical series with the primary winding of said transformer, so that Direct Current pulses are supplied to said primary winding.

5. The electrical system recited in claim 4, wherein said system further includes an electronic switch means interconnected with said transformer primary winding to control the flow of said current pulses therethrough, and pulse source means providing a signal to control the operation of said switch means and thereby selectively establish the width of said current pulses that are supplied to said primary winding.

6. The electrical system recited in either of claims 1 or 5, further including means by which to control the repetition rate of said current pulses so as to be substantially equal to the self-resonating frequency of the transformer.

7. The electrical system recited in claim 1, wherein said system further includes an electronic switch means interconnected with said transformer primary winding to control the flow of said current pulses therethrough, pulse source means providing a signal to control the operation of said switch means and thereby selectively establish the width of said current pulses that are supplied to said primary winding, and a zero crossing detector by which to control the repetition rate of said current pulses so as to be substantially equal to the self-resonating frequency of the transformer, said zero crossing detector connected between said electronic switch means and said pulse source means and responsive to the polarity of the output voltage developed at the transformer primary winding, said zero crossing detector controlling both the width and rate of the control pulses being supplied by said pulse source means to said electronic switch means depending upon the polarity of the transformer output voltage.

8. The electrical system recited in claim 1, wherein said load comprises at least one gas discharge lamp.

9. The electrical system recited in claim 1, wherein said transformer is on a duty cycle of less than or equal to 25%.

10. For interconnection in an electrical circuit including a source of Direct Current pulses, an efficient transformer for driving a load, said transformer having a primary winding to receive Direct Current pulses from said source thereof, said transformer also having a secondary winding interconnected with said load so as to provide a driving voltage to said load, and said transformer further being fabricated from a ferrite material, whereby to cause said transformer to have a characteristic self-resonating frequency, the widths of said Direct Current pulses being less than or equal to one fourth the wavelength of the self-resonating frequency of the transformer.

11. The transformer recited in claim 10, said electrical circuit further including means by which to adjust the widths of the current pulses being supplied to said transformer primary winding, said adjusting means comprising:

electronic switch means connected in electrical series with said transformer primary winding to control the flow of said current pulses therethrough, and pulse source means providing pulses to control the operation of said switch means, so as to selectively vary the widths of said current pulses.

12. The transformer recited in claim 11, wherein the width of the control pulses from said pulse source means is selected to be less than or equal to one-fourth of the wavelength of the self-resonating frequency of the transformer.

13. The transformer recited in claim 10, wherein the primary winding thereof comprises 20 wire turns that are capable of supporting a voltage thereacross of approximately 8 volts per turn.

14. A method for efficiently powering an electrical load by means of a transformer having primary and secondary windings and a core, said method comprising the steps of:

forming said transformer from a material to cause said transformer to have a self-resonating frequency, driving the primary winding of said transformer by Direct Current pulses, and controlling the widths of said current pulses so as to be less than or equal to one-fourth the wavelength of the self-resonating frequency of the transformer.

15. The method for powering a load recited in claim 14, including the additional step of forming said transformer from a ferrite material.

16. The method for powering a load recited in claim 14, including the additional step of controlling the repetition rate of said current pulses so as to be substantially equivalent to the self-resonating frequency of the transformer for causing said transformer to have a variable duty cycle of relatively short duration.

* * * * *